US009079388B2

(12) United States Patent
Schreiber et al.

(10) Patent No.: US 9,079,388 B2
(45) Date of Patent: Jul. 14, 2015

(54) CONTROL OF A PRINTING PRESS USING A TORSION MODEL AND PRINTING PRESS CONTROLLED BY TORSION MODEL

(75) Inventors: Stefan Schreiber, Edingen-Neckarhausen (DE); Bernhard Buck, Heidelberg (DE); Werner Joss, Linkenheim-Hochstetten (DE); Malte Seidler, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 786 days.

(21) Appl. No.: 11/707,785

(22) Filed: Feb. 16, 2007

(65) Prior Publication Data

US 2007/0186793 A1 Aug. 16, 2007

Related U.S. Application Data

(60) Provisional application No. 60/777,246, filed on Feb. 27, 2006.

(30) Foreign Application Priority Data

Feb. 16, 2006 (DE) ..... 10 2006 007 181

(51) Int. Cl.
*B41F 33/00* (2006.01)
*B41F 13/004* (2006.01)

(52) U.S. Cl.
CPC ..... *B41F 13/0045* (2013.01); *B41F 33/00* (2013.01)

(58) Field of Classification Search
CPC ..... B41F 13/0045
USPC ..... 101/248, 481, 484, 485, DIG. 36, 211
See application file for complete search history.

(56) References Cited

U.S. PATENT DOCUMENTS 5,036,764 A 8/1991 Rodi
5,366,303 A * 11/1994 Barrus et al. ..... 400/234
(Continued)

FOREIGN PATENT DOCUMENTS

DE 31 48 449 C1 6/1983
DE 42 10 988 A1 10/1993
(Continued)

OTHER PUBLICATIONS

EPO Machine Translation of EP 709184 A1.*
(Continued)

*Primary Examiner* — Judy Nguyen
*Assistant Examiner* — Jennifer Simmons
(74) *Attorney, Agent, or Firm* — Laurence A. Greenberg; Werner H. Sterner; Ralph E. Locher

(57) ABSTRACT

A method and an apparatus control a printing press having a plurality of printing units, a plurality of cylinders which are coupled mechanically to one another and a control computer for controlling at least one drive motor which drives the mechanically coupled cylinders. A torsion model is stored in the machine computer for describing the torsion state of the cylinders in the printing press which are rotatably coupled mechanically to one another, as a function of at least one measurable operating parameter or at least one variable of the printing press which is known to the machine computer. A control of the printing press is performed by the control computer on the basis of the values which are calculated by the torsion model.

18 Claims, 3 Drawing Sheets

(56) References Cited

U.S. PATENT DOCUMENTS

| | | | | | |
|---|---|---|---|---|---|
| 5,584,244 | A | | 12/1996 | Klinger et al. | |
| 5,586,499 | A | * | 12/1996 | Beaumont et al. | 101/211 |
| 5,596,931 | A | * | 1/1997 | Rossler et al. | 101/484 |
| 6,427,590 | B1 | * | 8/2002 | Rossler et al. | 101/181 |
| 2004/0118311 | A1 | * | 6/2004 | Tokiwa | 101/485 |

FOREIGN PATENT DOCUMENTS

| | | | | |
|---|---|---|---|---|
| DE | 4407631 | C1 | | 10/1995 |
| DE | 44 34 843 | A1 | | 4/1996 |
| DE | 10 2004 031 508 | A1 | | 2/2006 |
| EP | 709184 | A1 | * | 5/1996 |
| JP | 08052860 | A | * | 2/1996 |
| JP | 2000-225689 | A | | 8/2000 |

OTHER PUBLICATIONS

JPO Machine Translation of JP 0852860 A.*

* cited by examiner

CONTROL OF A PRINTING PRESS USING A TORSION MODEL AND PRINTING PRESS CONTROLLED BY TORSION MODEL

CROSS-REFERENCE TO RELATED APPLICATIONS

This application claims the priority, under 35 U.S.C. §119, of German application DE 10 2006 007 181.6, filed Feb. 16, 2006; this application also claims the priority, under 35 U.S.C. §119(e), of provisional application No. 60/777,246 filed Feb. 27, 2006; the prior applications are herewith incorporated by reference in their entireties.

BACKGROUND OF THE INVENTION

Field of the Invention

The present invention relates to a method and an apparatus for controlling a printing press having a plurality of printing units, a plurality of cylinders which are coupled mechanically to one another and a control computer for controlling at least one drive motor which drives the mechanically coupled cylinders.

Sheet-fed rotary offset printing presses have a plurality of printing units which in each case apply a separation of a printed image onto the printing material in a defined color. There are usually at least four printing units, in order for it to be possible to print the three primary colors red, yellow, blue, and also black. However, still further printing units can be provided for special colors, such as gold or silver. It is additionally possible to apply a varnish to the printing material with a special varnishing unit after the printing units. In addition, sheet-fed rotary printing presses can process the front and rear sides of a printing material, with the result that double the number of printing units and varnishing units are to be provided in this case. In printing presses for recto and verso printing having a plurality of special colors and subsequent varnishing units, this leads to a considerable number of printing and varnishing units. Therefore, a number of sixteen printing and varnishing units is therefore no longer unusual in packaging material.

As all the printing units print their color separations over one another, it is important that the overprinting takes place with accurate register, that is to say there may not be any deviation in the positioning if possible between the individual color separations on the printing material, as otherwise visible image errors occur for the observer of the finished printed product. The individual printing and varnishing units in sheet-fed rotary printing presses are usually connected to one another via a gearwheel train, in order to also to achieve this register accuracy during overprinting of different color separations. In this case, the plate cylinders, blanket cylinders, impression cylinders and transport cylinders, as well as turner drums of the printing press are coupled mechanically to one another and are driven jointly by one or more drive motors. Here, the mechanically coupled cylinders represent a system with a finite rigidity, with the result that torsion phenomena are produced at defined loads. Moreover, adjustment possibilities for the register adjustment are provided in the printing units of each sheet-fed offset printing press, in order for it to be possible if required to correct register deviations between the individual color separations, as the deviations depend, inter alia, on the printing speed, and the latter is not identical in every print job. It has been proven that the setting of the registers is dependent not only on the printing speed but also on the torque of the drives or other operating parameters of the printing press.

German patent DE 31 48 449 C1, discloses a method for reducing register errors in multiple-color offset printing presses, the printing units of which are driven by a common motor and have a device for register adjustment. This invention is based on the functional relationship between the torque which is supplied by the drive motor of the printing press or a variable which is characteristic of the torque and the register adjustment in the printing press which is necessary for maintaining satisfactory register. The functional relationship between the torque and the necessary register setting is stored in a computer of the printing press. During continuous operation of the printing press, the torque which is supplied by the drive motor is monitored and the register adjustment is performed as a function of the respective torque. Here, the relationship between the torque and the register adjustment is either determined during a test run of the printing press and stored in the form of a value table, or calculations are carried out which result in value pairs containing the torque and the register adjustment. There is also a value table in this case, which value table can be made use of during printing operation. The advantage of a procedure of this type lies in the fact that there does not have to be a complicated control computer, as only a comparison between the currently determined torque and the value table has to take place, whereupon the corresponding register adjustment values are then called up in the control computer and used. However, the method has the great disadvantage that it cannot react to changes within the printing press, which changes occur after delivery of the printing press to the customer, as the value table which is stored in the printing press cannot take the changes into consideration.

SUMMARY OF THE INVENTION

It is accordingly an object of the invention to provide control of a printing press using a torsion model and printed press controlled by the torsion model, which overcomes the herein-mentioned disadvantages of the heretofore-known methods and devices of this general type, with which the maintenance of register can be improved further in offset printing presses and which can react to changes in operating parameters of the printing press during printing operation.

With the foregoing and other objects in view there is provided, in accordance with the invention, a method for controlling a printing press having a plurality of printing units, at least one drive motor, a plurality of cylinders coupled mechanically to one another, and a control computer for controlling the at least one drive motor driving the cylinders mechanically coupled to one another. The method includes storing a torsion model in the machine computer for describing a torsion state of the cylinders in the printing press, as a function of at least one measurable operating parameter or at least one variable of the printing press known to the machine computer. The printing press is controlled, via the control computer, on a basis of values calculated by the torsion model.

The present invention can be used in all printing presses, in which a plurality of impression cylinders, blanket cylinders, plate cylinders or transport cylinders are coupled mechanically to one another. The mechanical coupling has the effect that changes in one of the cylinders necessarily also have an effect on the other cylinders which are coupled to the former. The invention is almost predestined to be used in sheet-fed offset printing presses, in which all the cylinders or at least the majority of the cylinders are connected to one another by a mechanical coupling, such as a continuous gear train or a longitudinal shaft. In addition, the printing press according to the invention has at least one drive motor which drives the mechanically coupled cylinders and a control computer, in which a mathematical torsion model is stored in the form of software for describing the torsion state of the cylinders which are coupled rotatably and mechanically to one another in the control computer of the printing press. The torsion model represents an algorithm which can constantly recalculate the mechanical rotation and position with respect to one another of the individual cylinders which are coupled to one another, as a function of at least one measurable operating parameter or a variable which is known to the control computer, also during operation of the printing press. The operating parameters and the known variables can be, for example, a current torque of one or more drives, the power usage of the drives, operating temperatures, used printing units, components which are switched on, settings of inking zone openings in the printing units, etc. The control computer can then intervene in the control of the printing press on the basis of the values which are calculated by the torsion model during operation of the printing press. This procedure has the great advantage that changes in the torsion state of the printing press can also be taken into consideration during printing operation, which changes are produced, for example, on account of the change in environmental conditions such as temperature and air humidity. Furthermore, the running of the printing press can become easier or stiffer during operation, so that changes can also result in the torsion state of the cylinders which are coupled to one another. If the corresponding operating parameters of the printing press are detected by sensors and fed to the machine computer with the torsion model, corresponding values can be calculated for correcting settings of the printing press and the corresponding setting processes can be triggered.

There is provision in a first refinement of the invention for at least one variable which is characteristic of the power requirement of the at least one drive motor to be measured as an operating parameter and to be fed to the control computer of the printing press. The power requirement of the printing press can be detected, for example, via measurement of the current of the drive motor. The greater the detected current is, the more electrical power the drive motor is drawing from the electrical network. The power requirement of the drive motor can change, for example, as a result of a change in the printing speed. If the printing speed is increased, the power requirement of the drive motor also changes necessarily, because correspondingly more drive power is required for a higher printing speed. However, the power requirement of the printing press can also change at a constant printing speed, for example as a result of warming. However, the settings do not remain unaffected by the change in the power requirement of the printing press. With consideration of the measured power requirement of the drive motor, the effects on the torsion state of the printing press can be calculated by the torsion model in the machine computer. Corresponding changes to the settings of the printing press can then be initiated by the control computer.

Furthermore, there is provision for the torque which is fed into the cylinders by the at least one drive motor to be measured as an operating parameter and to be fed to the control computer of the printing press. In addition to the measurement of the power requirement of the drive motor or as an alternative, the torque which is fed into the cylinders of the printing press can also be detected. The torque can likewise be detected via the drive motor or via additional torque sensors which measure the torque at individual cylinders of the printing press or at gearwheels of the gearwheel train. The detected torque values are likewise fed to the torsion model in the machine computer of the printing press, so that the torsion state of the printing press can be calculated there as a function of the respectively detected torque. The corresponding, necessary settings of the printing press can therefore also be performed by the control computer.

There is provision in one particularly advantageous refinement of the invention for an adjustment of the registers and/or an adjustment of the front lay in the printing units to be performed by the values which are calculated by the torsion model. If there is a varnishing unit, it goes without saying that the maintenance of register can also be adjusted in a varnishing unit of this type. As was mentioned in the introduction, the maintenance of register is particularly sensitive during overprinting of the different color separations in order to achieve a high print quality, which relates to changes in the operating state of the printing press. This relates, above all, to changes in the torsion state of the cylinders which are connected to one another in the printing press. For instance, the gear train can be relieved during heating and during the processing of a print job, which has the consequence of a change in the register setting. In practice, the printer learns of a register setting of this type only by the fact that he pulls test sheets and notices the change in the registers there, or has installed an automatic register monitoring device in the printing press, which register monitoring device automatically regulates the register deviation. However, an automated register monitoring device of this type is expensive and not available for every printing press. Moreover, corresponding special measuring marks have to be provided on the printing material, which special measuring marks correspondingly take up space on the printing material, which space could otherwise be used for the printed image itself. However, it is possible with the use of the torsion model to constantly recalculate the torsion state in the printing press in a current manner using operating parameters such as the changed power requirement or torque change, and to perform an adjustment of the registers in the individual printing units or varnishing units on this basis. In this case, a complicated automated register regulating device is not necessary, and it is sufficient to control the registers using the values which are calculated by the torsion model. If the printer so desires, the changed values of the register adjustment can be displayed first on a display screen of the printing press, with the result that the printer can decide himself whether he would like to perform the register adjustment by hand or desires to leave it to the printing press. In the latter case, the work of the printer can be made easier by the fact that the register adjustment is performed automatically by the control computer of the printing press. In this case, the printer no longer has to consider the transfer of the correct values for the register adjustment. In addition to the register adjustment, an adjustment of the front lay on the feeder is also possible. This adjustment ensures that the paper edge in the transport gripper on a reference cylinder, preferably in the machine center or near the main drive, is tracked to form a reference state if the operating state changes. This increases the reproducibility of the sheet transfer as a result of the paper projecting length on the reference cylinder being made more uniform, the paper projecting length also being changed in the front printing units, however. In the following text, the adjustment of the front lay is also always possible in addition to the register adjustment.

There can advantageously be provision for the printing press to have a measuring device for monitoring the registers, and for, during the detection of register deviations in the control computer by the torsion model, the register adjustment and/or the adjustment of the front lay in the printing units to be corrected. In this case, regulation of the registers is provided in addition to the controller, by register marks on the printing materials being detected in the printing press or on a separate measuring table and being fed to the control computer of the printing press. In order to improve the regulation of the register adjustment, the detected deviations in the registers of the individual printing units or varnishing units are likewise fed, however, to the torsion model in the control computer of the printing press, with the result that the torsion state in the printing press can also be taken into consideration in the calculation of the actuating variables for the correction of the register deviation in the control computer. This leads to a considerable improvement in comparison with conventional register regulation, as the correction of the register deviation can be carried out in a more targeted manner, with the result that fewer regulating steps are necessary for correcting the register deviation by the control computer. However, a reduction of regulating steps in the correction of register deviations leads to it being possible for the register deviations to be adjusted more rapidly. This in turn has the consequence that fewer printing materials are produced, on which corresponding register deviations of the individual color separations can be seen, with the result that waste paper is reduced.

Moreover, there is advantageously provision for the register adjustment and/or the adjustment of the front lay to be set correctly for at least one selected operating state of the printing press, and for the correct setting values of the register adjustment and/or the adjustment of the front lay to be stored in the control computer of the printing press in conjunction with the associated selected operating state. The selected operating state can be, for example, a defined machine configuration or a defined printing speed. In this case, the printer can set the registers himself in the individual printing units in a setup mode which is carried out at a low printing speed, until the result corresponds to his wishes. In this case, the selected printing speed is the setup speed. In this way, influences from the printing plate exposure, the clamping process of the printing plates and the torsion state of the machine can be corrected at the setup speed. When the result corresponds to the wishes of the printer, he can acknowledge this to the control computer of the printing press by a corresponding input. A storage process is triggered by this acknowledgement signal, in which storage process register adjustment values which have been set, the currently consumed drive power or the torque and additional other data are stored in the printing press controller. After this, the printer can then switch the printing press to printing operation and bring it up to full machine speed. As a function of the machine speed which is then reached, the machine controller calculates corresponding register adjustment values using the torsion model and the stored register adjustment values at setup speed, in order also to ensure satisfactory printing at full machine speed. This dispenses with the manual tracking of register adjustment values which is otherwise customary for the printer, if the printing speed of the printing press is changed. This can go so far that, if the printing speed is changed, the register adjustment is corrected automatically at a changed printing speed on the basis of the register adjustment which is set correctly for the selected printing speed, with the torsion model being taken into consideration. As soon as the printer operates his machine at another speed, a corresponding correction of the register adjustment is performed by the torsion model, without it being necessary for the printer to intervene.

There is provision in one refinement of the invention for a plurality of components or printing units of the printing press to be influenced by the detection of one operating parameter. As has already been mentioned, an operating parameter of this type can be the power consumption or the torque requirement of the printing press. In order for it to be possible to perform the register adjustment correctly in individual printing units or varnishing units, the corresponding register deviations normally have to be detected via sensors. This is then no longer necessary if the control computer with an implemented torsion model is used, as it is sufficient for a plurality of printing units of the printing press to be influenced using a single detected variable, such as the power requirement of the printing press. As the torsion model takes into consideration and describes the torsion state and therefore the coupling of the cylinders in the individual printing units of the printing press, the effect of the adjustment of registers in the individual printing units with respect to one another is also taken into consideration. The effect of an operating variable such as the power requirement on all the printing units or varnishing units of the printing press can be calculated by the torsion model, with the result that the machine controller can then perform the corresponding corrections on all printing units or varnishing units via the register adjustment device.

Furthermore, it is possible for the torsion state of the printing press to be detected using measuring technology at at least two locations, by use of sensors. Sensors are to be provided in the printing press at least two locations, which sensors, for example, additionally measure the torsion via the respectively prevailing torque or the differential rotation between the sensors. The measured values can be included in the torsion model, in order to check it at least two locations for any correction requirement. In this case, not only are values calculated using the torsion model, but measured values are also used for checking purposes, which increases the accuracy. The measured values can be used for interpolation of values which lie between them by the torsion model. The measured values which are determined by the sensors can also be used to optimize the torsion model during operation. In this case, the measured values are taken into consideration in a type of adaptive controller, by the parameters of the torsion model correspondingly being adapted continuously or at defined time intervals.

There is advantageously provision for it to be possible for the torque distribution in the printing units of the printing press to be set in a variable manner or to take place as a function of the machine configuration. In addition to the register adjustment in the individual printing units, register corrections can also be carried out by the torque distribution in the individual printing units being changed, for example, as a function of the printing speed. This can take place by braking in the printing units, or additional drive motors can be provided, with which the torque distribution can be changed. It has proven particularly advantageous if the torque distribution of the drive motor in the printing units takes place as a function of the respective configuration of the printing units. The torque requirement in the individual printing units is dependent, inter alia, on how many printing units are actually used for the respective print job, whether the machine is operated, for example, in recto printing or in verso printing, and the nature in each case of the inking zone opening. All these configurations which are dependent on the respective print job have the consequence of a changed torque requirement in the individual printing units. This requirement can also be calculated by the torsion model, in order thus to improve the print quality on the printing materials.

There is provision in a further refinement of the invention for positional deviations with regard to the front and rear side of a printing material to be corrected, by the torsion model, by the register adjustment after a turner drum during recto and verso printing. The torsion state is also set at every printing speed in recto and verso printing, exactly as in pure recto printing. If this torsion state changes on account of a changed power consumption or a changed torque requirement, this is also associated here with register changes, as in pure recto printing. However, in recto and verso printing, the register accuracy between the printed images on the front and rear sides of the printing material also changes additionally. However, there must also not be any register deviation if possible between the printed image on the front side and the rear side, as otherwise edgeless trimming of the printing material is not possible, for example, without parts being cut off either in the printed image on the front side or in the printed image on the rear side on account of the different position. Register deviations which are as small as possible between the front side and the rear side are therefore also desired. These deviations can also be calculated by the torsion model in the machine controller, and the corresponding corrections can therefore be performed in the printing press.

There is provision in one particularly advantageous refinement of the invention for the changing torsion state of the printing press to be calculated, for the register deviation which has been experienced by a printing material in the printing press before the turner drum to be calculated from the calculated torsion state, and for the register adjustment for the printing units after the turner drum to be loaded with twice the value of the paper edge loss in relation to the printing units before turning, in order to correct the register deviation. In this case, the register deviation between the front side and the rear side of the printing material is corrected via the register adjustment device on the printing units and varnishing units after the turning device. The current torsion state is calculated by the torsion model, which results in the paper edge loss of the printing material being summed over the printing units before turning. Register adjustment values are calculated therefrom accordingly, and as in pure recto printing, by the torsion model. For the printing and varnishing units after the turning device, all the register adjustment values are corrected by twice the determined paper edge loss, with the result that register deviations no longer occur between the printed images on the front side and the rear side. It is therefore also possible by the present invention to avoid register deviations reliably in recto and verso printing.

A further advantageous refinement of the invention results from an improvement in the model results by a calibration test which is individual to the machine. As both the compliance of the gear train and the current/torque characteristics of the drive can have relatively small variances, the individual result on one machine can be improved by a standardized printing test being carried out under real conditions before delivery of the machine to the customer, and by the results of the torsion model then being improved, such as scaled, with the aid of the values discovered by the standardized printing test. In the simplest case, a scaling factor is superimposed on all values here for correction. The calibration is required only once.

Other features which are considered as characteristic for the invention are set forth in the appended claims.

Although the invention is illustrated and described herein as embodied in control of a printing press using a torsion model and printed press controlled by the torsion model, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
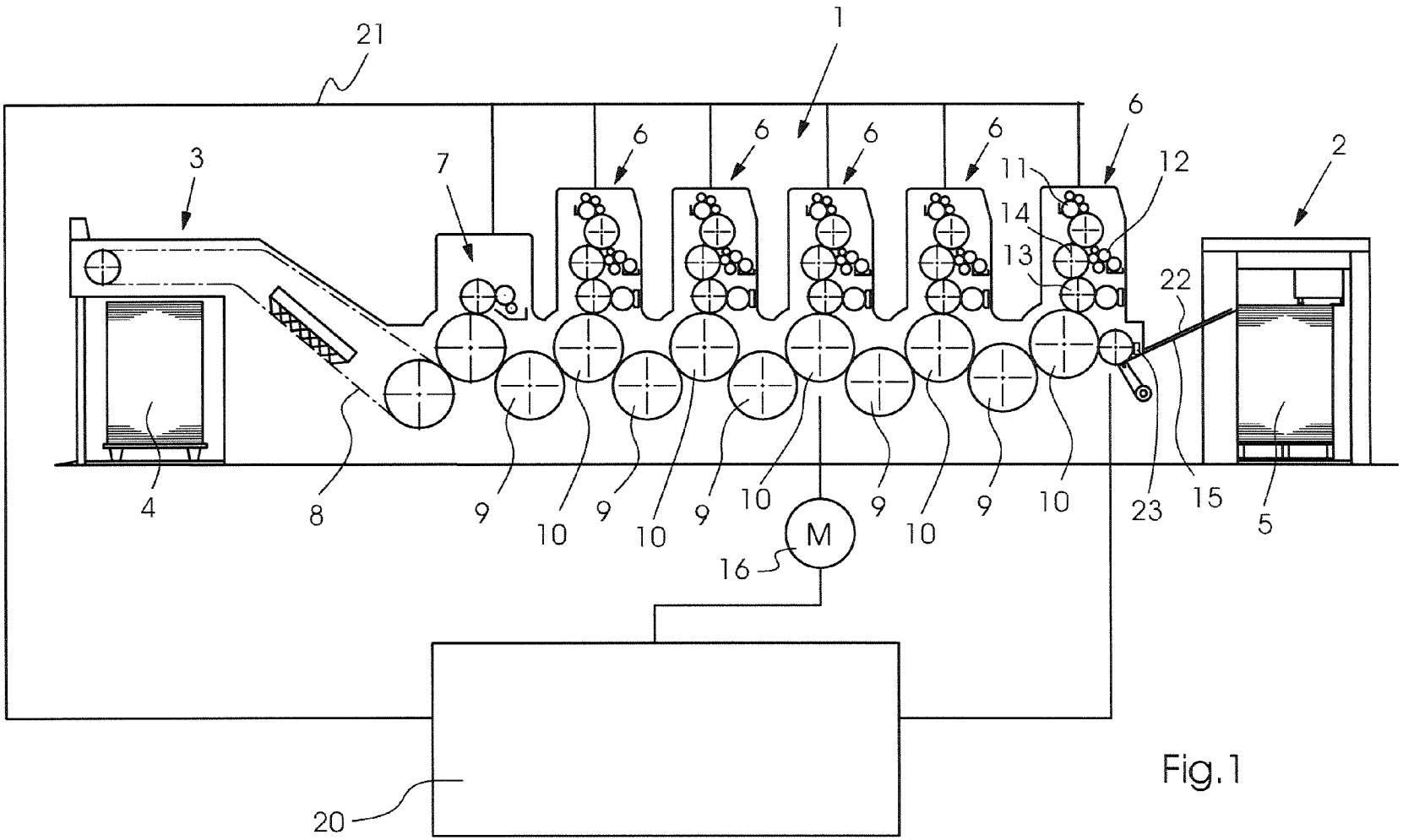
FIG. 1 is a diagrammatic, side-sectional view of a sheet-fed offset printing press, in which a register adjustment in printing units and in a varnishing unit is controlled via a torsion model stored in a machine controller according to the invention.

Referring now to the figures of the drawing in detail and first, particularly, to FIG. 1 thereof, there is shown a printing press 1 which processes sheet-shaped printing materials 22 in rotary offset printing. The printing press 1 has five printing units 6 and one varnishing unit 7. Here, the first four printing units 6 serve to apply the four primary colors yellow, red, blue and black in recto printing, while the fifth printing unit 6 is filled with special colors such as silver, gold or the like. The colors which are used in the printing units 6 are completely irrelevant, however, for the functioning of the present invention. After the fifth printing unit 6, the printed sheets 22 are provided with a varnish coat in the varnishing unit 7. The sheets 22 which are finished in the varnishing unit 7 are gripped by gripper bars on a deliverer transport chain 8 and deposited onto a deliverer stack 4 in the deliverer 3. When the deliverer stack 4 has reached its maximum height, it is removed and transported for further processing. The feeder 2 which removes sheet-shaped printing materials 22 from the feeder stack 5 and feeds them to the first printing unit 6 of the printing press 1 via a feed table 15 is situated on the opposite side of the printing press 1. The sheet-shaped printing materials 22 are transported from the first printing unit 6 to the varnishing unit 7 by cylinders 9, 10.

Each of the printing units 6 has an impression cylinder 10 which, together with a blanket cylinder 13, forms the press nip, in which the ink is applied to the sheet 22 in the printing unit 6. The printing ink itself is situated in every printing unit in an inking unit 11 which meters the printing ink in accordance with the settings of the current print job. In order to influence the print properties of the ink, a damping unit 12 is situated in every printing unit 6, moreover, with which damping unit 12 damping solution can be added in a targeted manner. The printing ink which is dampened this way is transferred in the printing unit 6 onto a plate cylinder 14 which carries a printing plate and transfers the applied printing ink onto the blanket cylinder 13 by a rolling movement. In principle, all the printing units 6 are of identical construction, this not necessarily needing to be the case. The sheets 22 in FIG. 1 are transported between the individual printing units 6 by a turner drum 9. The turner drums 9 allow the printing press 1 to be operated in recto and verso printing operation. The printed sheet 22 can be turned between each of the printing units 6 by the turner drum 9, with the result that both the front side and the rear side can be printed.

The varnishing unit 7 is situated behind the fifth printing unit 6, in which varnishing unit 7 a varnish coat can be applied in addition to the finished sheet 22. The printing press 1 in FIG. 1 is configured in such a way that all the cylinders 9, 10, 13, 14 and the inking units 11 and the damping units 12 are coupled mechanically to one another via a gearwheel train. It is possible here that individual printing units 6 or else cylinders 9, 10, 13, 14 can be decoupled from the continuous mechanical gear train by clutches. During printing operation, however, all the cylinders 9, 10, 13, 14 are coupled to one another in a fixed and mechanical manner and are driven by a common main drive motor 16. In FIG. 1, the main drive motor 16 drives a gearwheel of the impression cylinder 10 in the third printing unit 6, from where the force is transmitted via the gearwheel train to the other cylinders 9, 10, 13, 14 of the printing press 1.

The individual color separations and the varnish coat are printed over one another in the printing units 6 and in the varnishing unit 7. It is necessary for an optimum printed result that all the color separations and the varnish coat are printed over one another as exactly as possible, as otherwise image errors occur. This exact positioning over one another is called register maintenance in the printing industry. Although the cylinders 10, 13, 14 in the individual printing units 6 are coupled mechanically to one another, the gearwheel train has a certain elasticity, it being possible for individual cylinders, such as the plate cylinders 14 in the printing units 6, to be rotated with respect to one another within certain limits by a non-illustrated motor for register adjustment. The rotation of the cylinders 9, 10, 13, 14 of the machine which are coupled to one another depends, above all, on the operating state of the printing press 1. Here, the printing speed, in particular, plays a large role, but operating parameters such as surrounding temperature, air humidity, etc. are also to be taken into consideration. The rotation in the drive train of the printing press 1 can therefore change its state depending on the operating conditions. A torsion state results from the rigidity and the loading of the cylinders 9, 10, 13, 14 which are coupled to one another and can always be rotated a little with respect to one another, even if only to a small extent. The torsion state of the printing press 1 has the direct consequence of a change in the register maintenance of the sheets 22. During startup of the printing press 1, the printer therefore sets the register maintenance of the individual color separations in the printing units 6 and of the varnish coat in the varnishing unit 7 at the beginning of a print job, initially at a selected printing speed which usually lies considerably lower than the final production speed. This is effected in that some sheets 22 are produced which are then evaluated by the printer by a measuring device or a magnifying glass with the naked eye. The determined register deviations are corrected by an adjustment of the registers in the individual printing units 6 and in the varnishing unit 7.

In order to correct the register adjustment, the printing press 1 in FIG. 1 has a machine controller 20 which controls all the components of the printing press 1. The machine controller 20 has a computer which controls, for example, the main drive motor 16 of the printing press 1 and, moreover, is provided for controlling non-illustrated register adjustment motors in the individual printing units 6 and in the varnishing unit 7. For this purpose, the register adjustment devices in the printing units 6 and in the varnishing unit 7 are connected to the machine controller 20 via a communication link 21. The machine controller 20 in turn is connected to a non-illustrated input apparatus, such as a display screen and a keyboard, with the result that the printer can set up the printing press 1 in accordance with his stipulations. The printer can therefore perform the register adjustment in the individual printing units 6 and in the varnishing unit 7 manually via the machine controller 20. If there are corresponding register sensors in the printing press 1, the register adjustment can also be performed in a closed control loop. However, this is not necessary for the functioning of the present invention.

The present invention namely ensures that, if possible, regulating interventions are not necessary at all. The invention relates to a control measure which can precalculate register deviations which occur during operation using one or more operating parameters of the printing press 1 and can perform the register adjustment automatically.

Moreover, there is an adjustable front lay 23 on the feeder 2 of the printing press 1. The front lay 23 is also controlled by a machine computer 18. The front lay usually permits a change in the sheet position by +/−1 mm, as a result of which the sheet position in all further transport grippers on the cylinders 8, 9, 10 is also influenced at the same time. A calculation can then be carried out by the torsion model for one reference cylinder, for example one of the turner drums 9, as to how much the front lay 23 has to be adjusted, in order to have a desired sheet position in the transport gripper on the selected reference cylinder. There is therefore a further correction possibility as a result of the torsion model.

Figure 2:
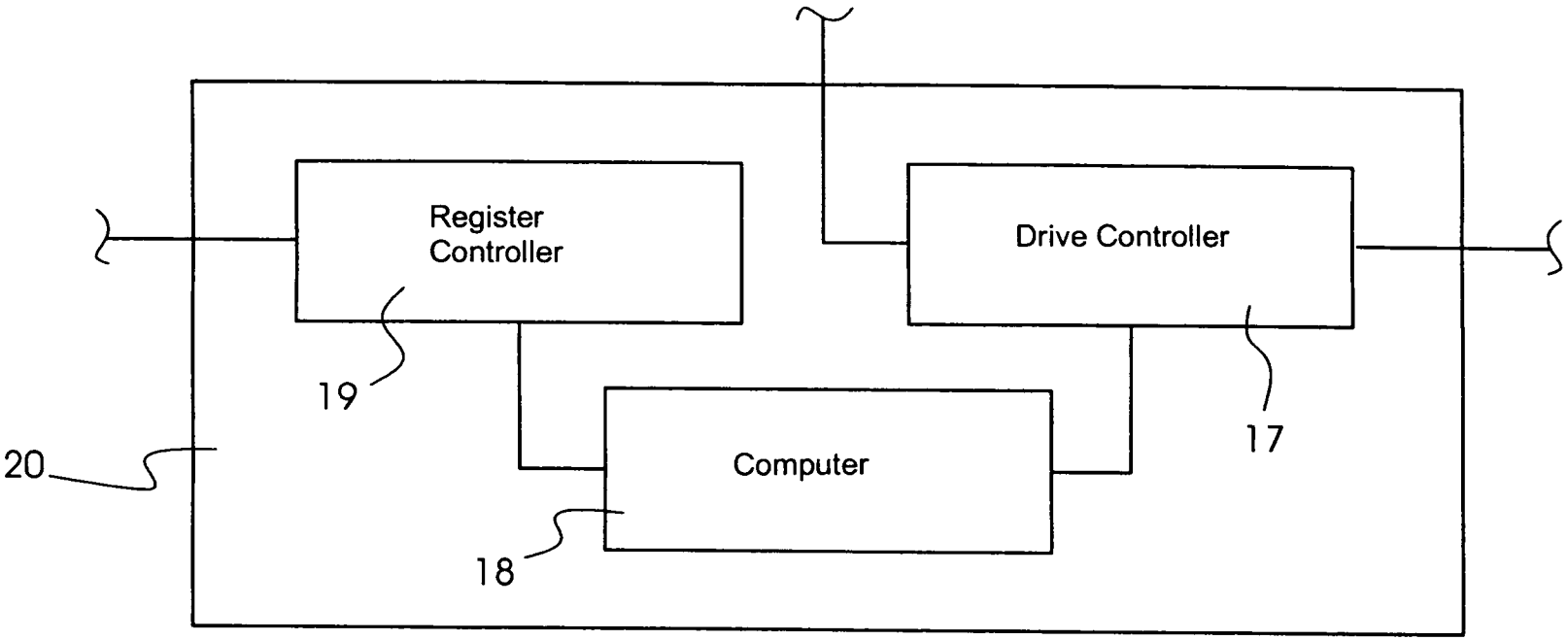
FIG. 2 is a block diagram of the machine controller of the printing press shown in FIG. 1.

The machine controller 20 from FIG. 1 is explained in greater detail in FIG. 2. The machine controller 20 contains the machine computer 18 which calculates and controls all the operating processes of the printing press 1. The machine computer 18 monitors and controls first a drive controller 17 which regulates the power requirement of the main drive motor 16 of the printing press. Second, the machine computer 18 also controls a register controller 19 which performs register adjustments in the individual printing units 6 and in the varnishing unit 7. The machine computer 18 is therefore the heart of the machine controller 20.

According to the invention, a torsion model of the printing press 1 is stored in the machine computer 18 in the form of software which makes it possible to calculate the torsion state of the printing press 1 as a function of the different parameters. Here, the torque which is output by the main drive motor 16 or the output performance can be suitable as operating parameters, or else the surrounding temperature or operating temperature of the printing press 1 and settings of the configuration in the individual printing units 6 of the printing press 1. It has been shown that it is sufficient to detect, for example, the power requirement of the main drive motor 16 constantly and to feed it to the torsion model in the machine computer 18, in order for it to be possible to determine the torsion state of the printing press 1. Adjustment values for the register adjustment in the individual printing units 6 and in the varnishing unit 7 can then be calculated using the determined torsion state, which adjustment values are then effected by the register controller 19. It is possible in this way to correct the register adjustment by the torsion model as a function of changing operating parameters, without it being necessary for the complicated regulating device to be provided in the printing press 1.

A correct register setting which was performed at a low setup speed can be converted by the printer by the torsion model to any other desired printing speeds of the printing press 1, with the result that the printer does not have to input any new values for the register adjustment in the event of changes to the printing speed.

If the printing press 1 operates in verso and recto printing operation, the coordination of the positions of the printed image on the front side and the rear side, what is known as the turning register, is also dependent on the torsion state of the printing press 1, in addition to the register maintenance. The printing press 1 in FIG. 1 can be operated, for example, in recto and verso printing by the printing materials 22 being turned on the third turner drum 9 and therefore also being printed on the rear side in the fourth and fifth printing units 6. In order to achieve register maintenance of the printed image on the front side and rear side of the sheet 22, register adjustments have to be performed on the first three printing units 6, as in pure recto printing. It is to be noted in numbers four and five of the printing units 6 that the rear side is printed here, with the result that register deviations have a different effect on the register. The spacing of the printed image of the front side from the edge of the sheet 22 can be calculated using the torsion model in the machine computer 18, with the result that the spacing is available for the adjustment of the registers in numbers four and five of the printing units 6. Here, numbers four and five of the printing units 6 are loaded with twice the calculated paper edge loss of the sheet 22 after turning, with the result that ultimately the printed images on the front side and rear side of the sheet 22 lie over one another with accurate register.

Figure 3:
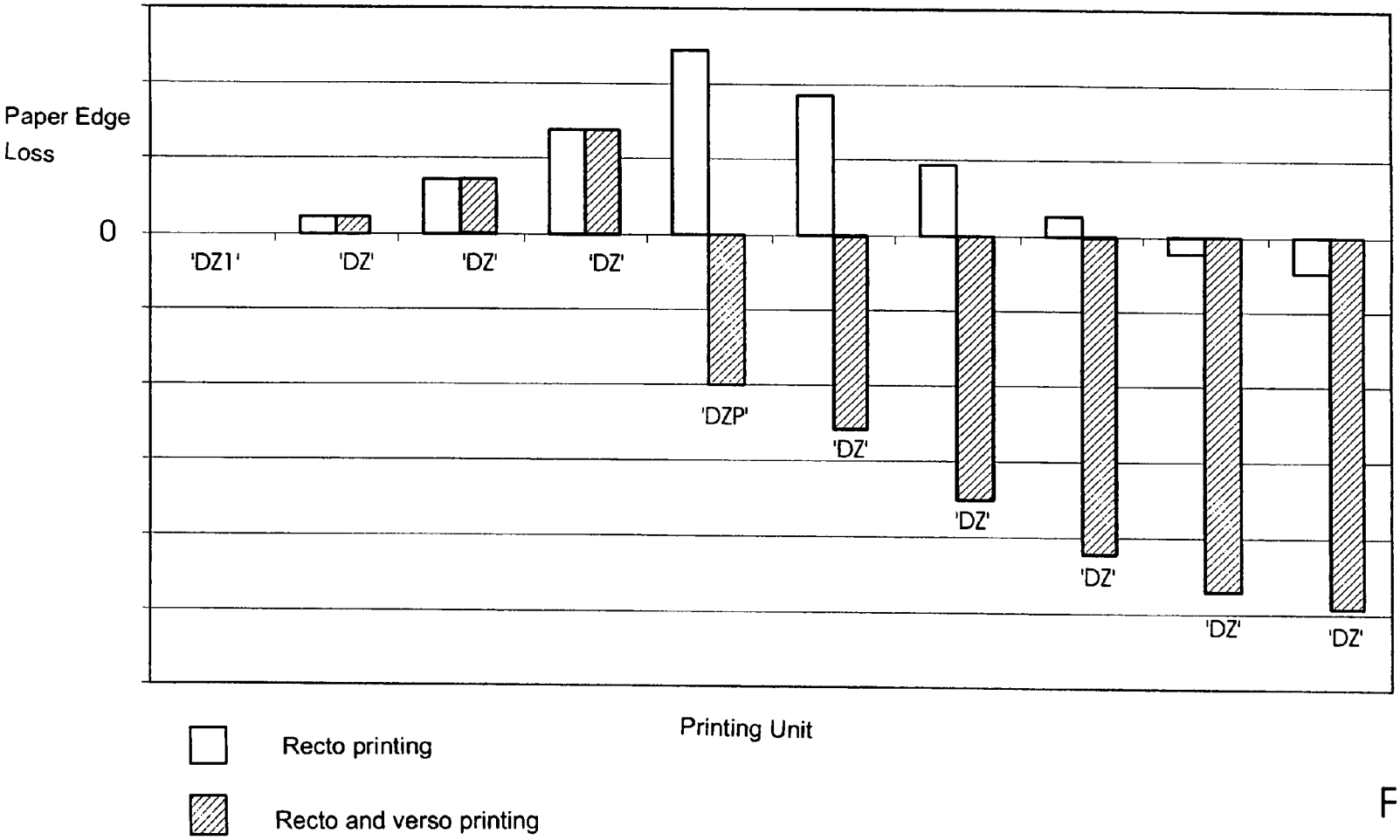
FIG. 3 is a diagram of a paper edge loss in recto and verso printing in a printing press having ten printing units.

The profile of the paper edge loss over all the printing units 6 of a printing press 1 is shown in FIG. 3 using the example of a 10-color printing press. Here, the turning device is situated between the fourth and the fifth printing units. The paper edge loss is plotted on the vertical axis in relation to the first printing unit. The first paper edge loss is set in the second printing unit and is increased in recto and verso printing operation as far as the fourth printing unit. After turning, a paper edge gain of the same magnitude as the overall sum on the recto printing side is set at the fifth printing unit. This gain is reduced as far as the tenth printing unit. In order to counteract this, the register adjustment has to counteract the values which are shown in FIG. 3, that is to say there must be a negative register adjustment on the recto printing side and a positive register adjustment on the verso printing side. In pure recto printing, positive correction is required only at numbers nine and ten of the printing units, whereas negative correction is required at numbers two to eight of the printing units. The correction values are calculated by the torsion model.

The present invention therefore makes particularly accurate control possible of the register maintenance in sheet-fed rotary printing presses 1 having a pure controller, without complicated regulation with register sensors being necessary. Simple retrofitting of already existing printing presses 1 with the technology according to the invention is therefore also possible, in order for it to be possible to improve their printing operation decisively.

We claim:

1. A method for controlling a printing press having a plurality of printing units, at least one drive motor, a plurality of cylinders coupled mechanically to one another, and a control computer for controlling the at least one drive motor driving the cylinders mechanically coupled to one another, which comprises the steps of:

storing a torsion model in the machine computer for describing a torsion state of the cylinders in the printing press, as a function of at least one measurable operating parameter or at least one variable of the printing press known to the machine computer;

the torsion model constantly recalculating mechanical rotation and position with respect to individual ones of the cylinders mechanically coupled to one another;

correcting, by means of the torsion model, positional deviations with regard to a front and rear side of a printing material by a register adjustment after a turner drum during recto and verso printing;

calculating a changing torsion state of the printing press resulting in a calculated torsion state;

calculating a register deviation which has been experienced by the printing material in the printing press before the turner drum from the calculated torsion state;

loading the register adjustment for the printing units after the turner drum with twice a value of a paper edge loss in relation to the printing units before turning, to correct the register deviation; and controlling the printing press via the control computer on a basis of values calculated by the torsion model.

2. The method according to claim 1, which further comprises:

measuring at least one variable being a characteristic of a power requirement of the at least one drive motor as the measurable operating parameter; and feeding the measurable operating parameter to the control computer of the printing press.

3. The method according to claim 1, which further comprises:

measuring a torque being fed into the cylinders by the at least one drive motor as the measurable operating parameter; and feeding the measurable operating parameter to the control computer of the printing press.

4. The method according to claim 1, which further comprises performing at least one of a register adjustment in the printing units and an adjustment of a front lay on a feeder of the printing press by the values calculated by the torsion model.

5. The method according to claim 4, which further comprises performing at least one of the register adjustment and the adjustment of the front lay automatically by way of the control computer of the printing press.

6. The method according to claim 4, which further comprises:

providing the printing press with a measuring device for monitoring registration; and during detection of register deviations in the control computer by the torsion model, correcting at least one of the register adjustment in the printing units and the adjustment of the front lay.

7. The method according to claim 4, which further comprises:

setting at least one of the register adjustment and the adjustment of the front lay correctly for at least one selected operating state resulting in correct setting values; and storing the correct setting values of at least one of the register adjustment and the adjustment of the front lay in the control computer of the printing press in conjunction with the selected operating state.

8. The method according to claim 7, wherein the selected operating state is a selected printing speed.

9. The method according to claim 8, which further comprises, if the selected printing speed is changed, correcting at least one of the register adjustment and the adjustment of the front lay at a changed printing speed on a basis of at least one of the register adjustment which is set correctly for the selected printing speed and a correctly set adjustment of the front lay, with the torsion model being taken into consideration.

10. The method according to claim 7, wherein the selected operating state is a printing speed during setting up of the printing press.

11. The method according to claim 1, which further comprises detecting the torsion state of the printing press using measuring technology at least two locations using sensors.

12. The method according to claim 1, which further comprises influencing a plurality of components or printing units of the printing press by a detection of one operating parameter.

13. The method according to claim 1, which further comprises setting a torque requirement in the printing units of the printing press in a variable manner.

14. The method according to claim 13, which further comprises distributing the torque requirement in the printing units as a function of a respective configuration of the printing units.

15. The method according to claim 1, which further comprises before performing a continuous printing operation of the printing press, performing a calibration run with a print job and measured values are detected in the process, from which correction values for the torsion model are calculated and are stored in the control computer.

16. A printing press, comprising:

a plurality of printing units each having a plurality of cylinders, at least some of said cylinders being coupled mechanically to one another;

at least one drive motor; and a control computer having a torsion model stored in said control computer for constantly recalculating mechanical rotation and position with respect to individual ones of said cylinders mechanically coupled to one another and for correcting register deviations, as a function of a change of at least one measurable operating parameter or at least one variable of the printing press known to said control computer;

the torsion model correcting positional deviations with regard to a front and rear side of a printing material by a register adjustment after a turner drum during recto and verso printing;

said control computer calculating a changing torsion state of the printing press resulting in a calculated torsion state;

said control computer calculating a register deviation which has been experienced by the printing material in the printing press before said turner drum from the calculated torsion state;

said control computer loading the register adjustment for said printing units after said turner drum with twice a value of a paper edge loss in relation to said printing units before turning, to correct the register deviation.

17. The printing press according to claim 16, further comprising a gearwheel train for mechanically coupling said at least some of said cylinders to one another.

18. The printing press according to claim 16, further comprising an apparatus for detecting one of a power requirement and a torque of said at least one drive motor.

* * * * *